United States Patent [19]

Craven

[11] 4,309,151

[45] Jan. 5, 1982

[54] LIQUID FUEL INJECTION PUMPING APPARATUS

[75] Inventor: John Craven, Whitstable, England

[73] Assignee: Lucas Industries Limited, Birmingham, England

[21] Appl. No.: 133,248

[22] Filed: Mar. 24, 1980

[30] Foreign Application Priority Data

May 3, 1979 [GB] United Kingdom ..... 15519/79

[51] Int. Cl.[3] ..... F04B 23/12

[52] U.S. Cl. ..... 417/206; 417/307; 417/462

[58] Field of Search ..... 417/205, 206, 307, 462

[56] References Cited

U.S. PATENT DOCUMENTS 3,363,569 1/1968 Roosa ..... 417/206 X

FOREIGN PATENT DOCUMENTS 726886 2/1966 Canada ..... 417/206

*Primary Examiner*—Richard E. Gluck

[57] ABSTRACT

A liquid fuel injection pumping apparatus for supplying fuel to an internal combustion engine comprises an injection pump to which fuel is supplied by a fuel pump. An air/fuel separator is provided and also a valve including a spring loaded piston for controlling the output pressure of the feed pump, the separator being connected to the outlet of the feed pump and the piston being subject to the output pressure of the pump. A space is defined in the pump housing and from which fuel can be drawn by the feed pump when the output pressure of the feed pump falls due to the entry of air into the feed pump. The air/fuel separator has a restricted outlet through which air and fuel can flow to an outlet in the housing and the space has an outlet which is placed in communication with the feed pump inlet by the piston.

7 Claims, 4 Drawing Figures

LIQUID FUEL INJECTION PUMPING APPARATUS

This invention relates to liquid fuel injection pumping apparatus for supplying fuel to an internal combustion engine and of the kind comprising a housing, a rotary distributor member located in the housing and arranged in use, to be driven in timed relationship with an associated engine, an annular cam ring surrounding the distributor member and located with a spaced defined in the housing, pumping plungers carried by the distributor member which are actuated by cam lobes on the cam ring as the distributor member rotates, to deliver fuel through passage means in the distributor member and housing to outlet ports in turn, a feed passage in the housing through which fuel under pressure can be supplied to effect outward movement of the pump plungers after actuation by the cam lobes, a fuel inlet in the housing, a positive displacement fuel feed pump having an inlet connected to said fuel inlet and an outlet which is connected to said feed passage, and a pressure control valve for controlling the pressure of fuel in said feed passage.

Such apparatus is well known in the art for supplying fuel to a compression ignition engine and it is the usual practice to provide an engine driven priming pump which draws fuel from the fuel tank and delivers it at low pressure to the fuel inlet of the apparatus. The provision of the priming pump facilitates priming of the fuel system if the fuel tank has been allowed to run dry. The priming pump is usually a simple type of diaphragm type pump and whilst it is comparatively cheap it does require an engine driven cam for its actuation and therefore the provision of the priming pump can present a considerable expense.

If the priming pump is omitted then there is the problem of priming the fuel system in the event that the tank is allowed to run dry and/or air has been drawn into the apparatus through the fuel inlet. In this situation if fuel is added to the fuel tank then the engine would have to be cranked by the starting motor for a considerable time before fuel would reach the fuel inlet. This would place an excessive strain on the electric storage accumulator and also on the starting motor. It is therefore desirable for the engine to run whilst fuel is being drawn to the fuel inlet and for this purpose a reservoir of fuel must be available. It is as essential however that this reservoir of fuel should not be substantially depleted after the fuel tank has run dry at least without some sort of warning being given to the operator.

The object of the present invention is to provide an apparatus of the kind specified in a simple and convenient form.

According to the invention in an apparatus of the kind specified an air separator is provided intermediate the outlet of the feed pump and said feed passage whereby in use air entrained in the fuel leaving the outlet of the feed pump is separated from the fuel, said pressure control valve comprising a spring-loaded plunger contained within a cylinder, one end of said cylinder being connected to said feed passage whereby the pressure of fuel in said feed passage will act on said plunger in opposition to the force exerted by the spring, a first port in the wall of the cylinder and which is uncovered by said plunger when the pressure in the feed passage reaches a predetermined value, to control the fuel pressure in said feed passage, a second port formed in said cylinder and positioned on the side of said first port remote from said one end of the cylinder, said second port communicating with the inlet of the feed pump, and a third port in said cylinder positioned to be placed in communication with said second port by said plunger in the event that the pressure of fuel in the feed passage falls to a low value due to the presence of air in the fuel flowing from the outlet of the feed pump, said third port communicating with a feed port opening into said space at a position such that fuel in said space can be drawn to the inlet of the feed pump.

According to a further feature of the invention said feed port is positioned such that it will be uncovered to air in said space before the fuel in said space is consumed.

Examples of fuel pumping apparatus in accordance with the invention will now be described with reference to the accompanying drawings in which.

Figure 1:
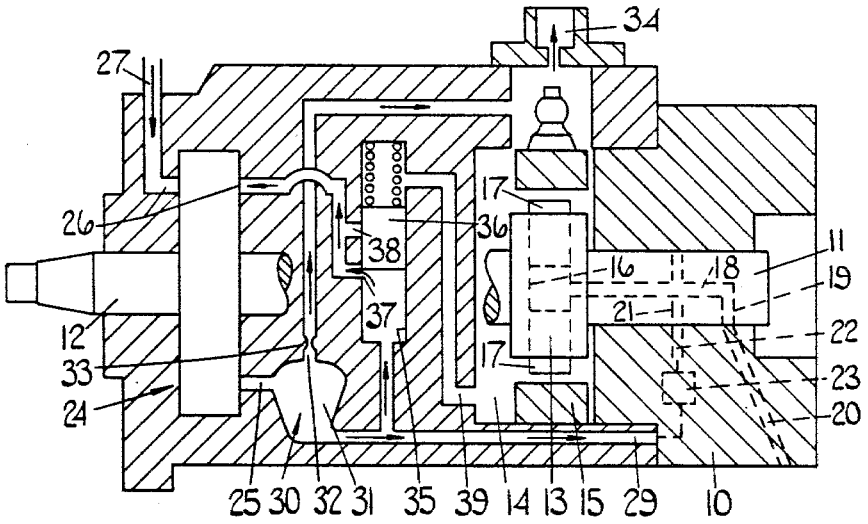
FIG. 1 is a sectional diagrammatic side elevation of one example of the apparatus showing parts thereof positioned for normal running.

With reference to FIG. 1 of the drawings the apparatus comprises a housing 10 in which is journalled a rotary cylindrical distributor member 11. The distributor member is coupled to a drive shaft 12 which extends from the housing and which in use, is driven in timed relationship with the associated engine. The distributor member has a head 13 which is located within a chamber 14 defined in the housing and located in the chamber is an annular cam ring 15 having pairs of cam lobes formed on its internal peripheral surface.

Extending within the head 13 is a transversely extending bore 16 in which is mounted a pair of pumping plungers 17 and these are adapted to be moved inwardly by the cam lobes as the distributor member rotates. During inward movement of the plungers fuel is displaced from the bore 16 and flows along a longitudinal passage 18 in the distributor member. The passage 18 communicates with a delivery passage 19 which during the inward movement of the plungers, is in register with one of a plurality of outlets 20 which in use, are connected to the injection nozzles respectively of the associated engine.

Fuel is supplied to the bore 16 during the intervals between delivery of fuel, through one of a plurallity of inlet passages 21 which move into register with an inlet port 22. The inlet port 22 communicates with a source of fuel as will be explained and the amount of fuel which flows through the port 22 whilst it is in communication with a passage 21 is determined by a fuel control means which is diagrammatically shown at 23. The fuel control means may be a simple throttle.

Mounted on the input shaft 12 is the rotary part of a fuel feed pump 24 and conveniently this is a positive displacement vane pump. The feed pump has an outlet 25 and an inlet 26 which is connected to a fuel inlet 27 formed in the housing and which in use, is connected to a fuel tank.

The outlet 25 of the pump is connected to a feed passage 29 which communicates with the fuel control 23. Immediately adjacent the outlet of the pump an air separator 30 is provided and this comprises a chamber 31 from the lower end of which the feed passage 29 extends. The outlet 25 of the pump leads into the upper portion of the chamber and from the top of the chamber extends an air bleed passage which incorporates a restrictor 33. The air bleed passage 32 communicates with the upper portion of the chamber 14 and leading from this chamber is an outlet 34 which in use, communicates with the fuel tank and which includes a non-return valve (not shown) disposed to prevent air being drawn into the chamber 14.

Also formed in the housing is a cylinder 35 in which is located a spring-loaded plunger 36, the plunger being loaded in the downward direction by the spring. The lower end of the cylinder is connected to the passage 29 and formed in the wall of the cylinder is a first port 37 which communicates with the inlet 26 of the feed pump. Moreover, a second port 38 is formed in the wall of the cylinder and this also communicates with the inlet of the feed pump. The second port 38 is positioned on the remote side of the port 37 from the lower end of the chamber. Finally the portion of the cylinder which contains the spring biasing the plunger communicates with the chamber 14 through a feed port 39. The position of the feed port 39 is carefully chosen and it will be noted that it is spaced above the lowest level of the chamber 14.

In operation, fuel flows from the outlet 25 of the feed pump into the chamber 31 of the air separator. Any air which is entrained in the fuel tends to rise in the chamber and flows along the passage 32 and is eventually returned to the fuel tank. The air-free fuel flows to the feed passage 29. The fuel then flows by way of the fuel control device 23 into the bore 16 and when inward movement of the plungers takes place a quantity of fuel is delivered at high pressure to an injection nozzle of the associated engine.

The pressure in the feed passage is controlled by returning fuel to the inlet of the pump. The pressure in the feed passage acts upon the plunger 36 against the action of its spring loading and the port 37 will be uncovered to permit fuel to return to the inlet of the feed pump. As the pressure increases then the plunger 36 will move to uncover the port 37 by an increased amount.

During use fuel collects in the chamber 14 due to leakage along the working clearances between the plungers and the bore 16 and also between the working clearance defined between the distributor member 11 and the bore in which it is located. In addition fuel together with air flows into the chamber 14 through the passage 32. The air entering the chamber 14 tends to flow through the outlet 34 and be returned to the tank. Some fuel however will also follow this route.

Figure 2:
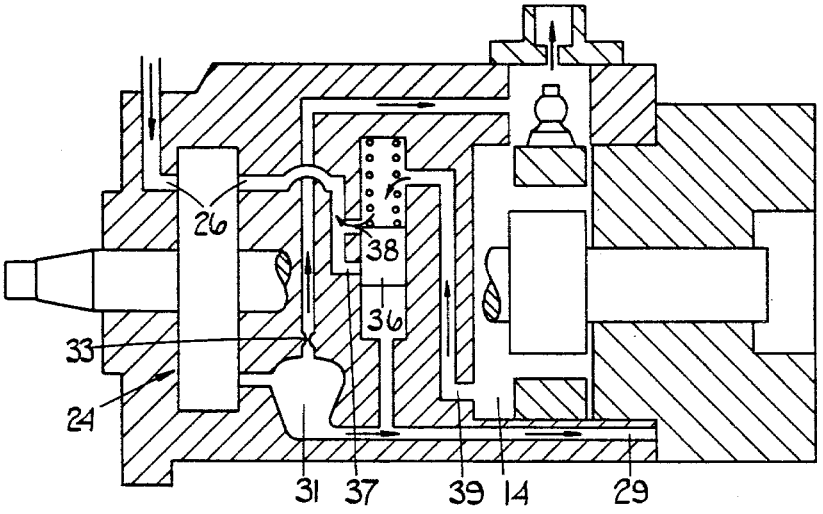
FIG. 2 is a view similar to FIG. 1 showing the parts in an alternative position.

In the event that a substantial quantity of air is drawn in through the fuel inlet 27 to the inlet 26 of the pump such for example as when the fuel level in the tank has been allowed to fall so low as to permit air to be drawn in through the intake pipe in the tank and which is connected to the fuel inlet 27, the air will collect in the chamber 31 of the air separator. As before the air will flow through the passage 32 but its rate of flow because of the restrictor 33 will be greater than if fuel were flowing through the passage 32. As a result the pressure in the feed passage 29 will fall and this will permit the plunger 36 to move downwardly under the action of its spring, by an amount sufficient to close the port 37 but also to open the port 38 to the portion of the cylinder containing the spring. Thus the ports 38 and 39 will be placed in communication with each other and this situation is shown in FIG. 2. Fuel will now be drawn from the chamber 14 to the inlet of the feed pump. By virtue of the operation of the air separator, substantially air free fuel will continue to flow along the feed passage 29.

The position of the port 39 which opens into the chamber 14, is chosen with care so that whilst initially there may be no substantial reduction in the rate of flow of fuel along the passage 29, the volume of fuel in the chamber 14 will be decreased until the port 39 is uncovered to air within the chamber. It will be understood that when the head 13 is rotating, the fuel in the chamber 14 will also tend to rotate and therefore as the volume of fuel decreases, a layer of fuel will tend to form about the wall of the chamber 14. As fuel continues to be drawn from the chamber 14 the port 39 will be uncovered to the air which has entered the chamber as fuel is drawn therefrom. As a result there will be a reduction in the rate of fuel supply to the engine and in effect the engine will be starved of fuel so that it will operate at a reduced speed. This is an indication to the operator of the engine that he should stop the engine and replenish the fuel tank with fuel.

Once the fuel tank has been replenished with fuel the engine can be started and fuel will once again be drawn from the chamber 14. As before however the engine will still be starved of fuel and will therefore only be able to operate at a reduced speed. Whilst the engine is operating however air and then fuel will be drawn in through the fuel inlet 27. The air as before will be separated in the air separator and gradually the various passages will become filled with fuel rather than air. It will be seen therefore that priming of the apparatus can be achieved with the engine running at a low speed and this minimises the strain on the starting motor of the engine and also the storage accumulator.

Figure 3:
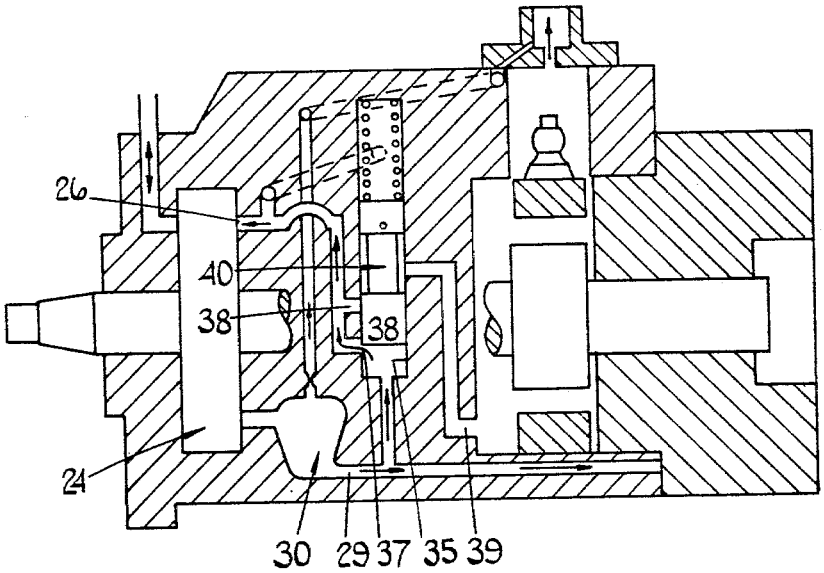
FIGS. 3 and 4 show modifications of the apparatus shown in FIG. 1.

In FIG. 3 of the drawings a slightly different construction of the regulating valve is illustrated. In the cylinder 35 is located a spool valve element 40. The ports 37 and 38 are connected to the inlet 26 of the feed pump as also is the portion of the cylinder 35 which accommodates the spring which is loading the spool valve. Moreover, instead of the port 39 being in communication with the portion of the cylinder 35 which accommodates the spring, it is in communication with the annular space defined by the cylinder and the reduced intermediate portion of the spool valve 40. When the pressure in the feed passage 29 falls the port 39 is placed in communication with the port 38 by way of the aforesaid annular space.

Figure 4:
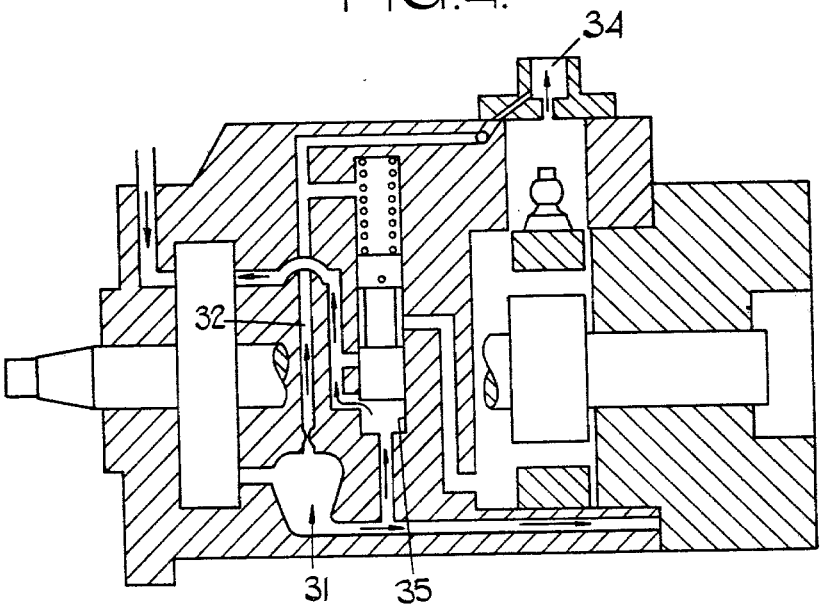

In FIG. 4 the construction of the regulating valve is essentially the same as is shown in FIG. 3 but in this case the portion of the cylinder 35 which contains the spring is in communication with the passage 32 which carries the air and fuel from the chamber 31 of the air-separator, to the outlet 34.

I claim:

1. A liquid fuel injection pumping apparatus for supplying fuel to an internal combustion engine comprising a housing, a rotary distributor member located in the housing and arranged in use, to be driven in timed relationship with an associated engine, an annular cam ring surrounding the distributor member and located within a space defined in the housing, pumping plungers carried by the distributor member which are actuated by cam lobes on the cam ring as the distributor member rotates, to deliver fuel through passage means in the distributor member and housing to outlet ports in turn, a feed passage in the housing through which fuel under pressure can be supplied to effect outward movement of the pump plungers after actuation by the cam lobes, a fuel inlet in the housing, a positive displacement fuel feed pump having an inlet connected to said fuel inlet and an outlet which is connected to said feed passage, a pressure control valve for controlling the pressure of fuel in said feed passage, an air separator provided intermediate the outlet of the feed pump and said feed passage whereby in use air entrained in the fuel leaving the outlet of the feed pump is separated from the fuel, said pressure control valve comprising a spring-loaded plunger contained within a cylinder, one end of said cylinder being connected to said feed passage whereby the pressure of fuel in said feed passage will act on said plunger in opposition to the force exerted by the spring, a first port in the wall of the cylinder and which is uncovered by said plunger when the pressure in the feed passage reaches a predetermined value, said first port communicating with the inlet of said feed pump to control the fuel pressure in said feed passage, a second port formed in said cylinder and positioned on the side of said first port remote from said one end of the cylinder, said second port communicating with the inlet of the feed pump, and a third port in said cylinder positioned to be placed in communication with said second port by said plunger in the event that the pressure of fuel in the feed passage falls to a low value due to the presence of air in the fuel flowing from the outlet of the feed pump, said third port communicating with a feed port opening into said space at a position such that fuel in said space can be drawn to the inlet of the feed pump.

2. An apparatus according to claim 1 in which said feed port is positioned such that it will be uncovered to air in said space before the fuel in said space is consumed.

3. An apparatus according to claim 2 in which said third port is in communication with the other end of said cylinder.

4. An apparatus according to any one of the preceding claims in which said air separator comprises a chamber through which fuel flows from the outlet of the feed pump to said feed passage, the chamber also having a restricted outlet from its upper end and through which in use, air and fuel flow to an outlet in the housing.

5. An apparatus according to claim 2 in which said plunger is in the form of a spool having a circumferential groove intermediate its ends, said third port in communication with said groove.

6. An apparatus according to claim 5 in which the other end of said cylinder communicates with the inlet of the feed pump.

7. An apparatus according to claim 5 in which the other end of said cylinder communicates with an outlet in said housing, said outlet also communicating with said space and with a restricted outlet for air and fuel from said separator.

* * * * *